US005238036A

United States Patent [19]

Bunce

[11] Patent Number: 5,238,036

[45] Date of Patent: Aug. 24, 1993

[54] GAS NOZZLE ADAPTER

[76] Inventor: Eugene B. Bunce, 149 W. Acton Rd., Stow, Mass. 01775

[21] Appl. No.: 819,457

[22] Filed: Jan. 10, 1992

[51] Int. Cl.[5] ..... B65B 57/06

[52] U.S. Cl. ..... 141/392; 141/206; 141/227; 141/286; 251/291

[58] Field of Search ..... 141/97, 98, 193, 198, 141/206, 207, 209, 227, 286, 290, 291, 390-392; 251/90, 291, 341, 342; 7/100, 114; 81/3.07, 3.4, 3.55, 488

[56] References Cited

U.S. PATENT DOCUMENTS 4,014,372 3/1977 Dichiara ..... 141/286
4,479,406 10/1984 Shoemaker, III ..... 81/3.55

*Primary Examiner*—Henry J. Recla
*Assistant Examiner*—Steven O. Douglas
*Attorney, Agent, or Firm*—Blodgett & Blodgett

[57] ABSTRACT

An adapter for a gasoline pump nozzle which is equipped with a gasoline fume return hose that extends over the rigid tubular portion of the nozzle. The hose has an outer open end which is normally aligned with the other open end of the rigid tube. The hose is resiliently compressible so that the outer end of the hose can be moved relative to the tube beyond a protuberance on the tube which is located between the outer end of the tube and the housing of the nozzle. The housing contains a valve in a trigger mechanism and a control mechanism which prevents the valve from being opened by the trigger mechanism when the hose is in its extended state but is effective to enable the valve to be opened by the trigger mechanism when the hose is compressed. The adapter has a handle in a main body portion which contains a slot in an outer opening to the slot. An adapter is utilized by grasping the nozzle, moving the outer end of the hose beyond the protuberance of the rigid tube and inserting the adapter between the protuberance and the end of the hose so that the rigid tube is located within the slot of the adapter. The end of the hose is released which effectively clamps the adapter between the protuberance and the outer end of the hose. This enables gasoline to be delivered to the gasoline receptacle by holding the nozzle with one hand.

11 Claims, 2 Drawing Sheets

GAS NOZZLE ADAPTER

BACKGROUND OF THE INVENTION

The present invention relates generally to a gasoline nozzle which is used for dispensing gasoline at a service station and relates particularly to a gasoline nozzle which is equipped with air pollution control equipment, such as a gasoline fume return hose. The gasoline nozzle includes a housing which contains a normally closed valve and a trigger mechanism on the housing for opening the valve. The inner end of a rigid cylindrical tube is fixed to the housing and is operatively connected to the valve. The outer end of the tube extends from the housing and terminates in a free open end. The gasoline fume return hose which is currently being used is fixed to the housing and extends from the housing over the rigid tube to the outer free end of the tube. The suction hose ha a bellows-like shape which enables the hose to be compressed lengthwise along the central longitudinal access of the rigid tube. The hose is biased to the extended position by an internal spring wherein the outer end of the hose is aligned with the outer end of the rigid tube. The rigid tube has an outer annular protuberance between its outer end and the housing. When the fume return hose is in its extended position, the trigger mechanism is ineffective to open the valve within the housing so that gasoline cannot be pumped into a receptacle which is being filled. When the fume return hose is compressed toward the housing until the outer end of the hose is beyond the annular protuberance on the rigid tube, the valve within the housing can be effectively opened by the trigger mechanism. When the nozzle is used to fill a receptacle such as the gas tank of an automobile, the end of the nozzle is positioned over the opening to the gas tank and pushed with sufficient force to compress the hose and allow the rigid tube portion of the nozzle to extend into the opening. When the gasoline fume return hose is compressed, the outer end of the hose is moved beyond the protuberance on the rigid tube to allow the user to pump gasoline into gas tank by operating the trigger mechanism. The hose is operatively connected to a vacuum source so that gasoline fumes from the gasoline which is deposited into the gasoline tank are drawn into the open end of the hose and returned to the storage tank.

The gasoline nozzle which is equipped with a gasoline fume return hose works quite well with modern vehicles. However, there are many types of receptacles for gasoline which can not be satisfactorily or effectively filled by this type of gasoline nozzle. One of the more difficult receptacles to fill is a gasoline can which holds a few gallons of gasoline for providing gasoline for gasoline powered equipment, such as chain saws, lawn mowers, snow blowers, garden equipment, etc. An empty gasoline can is quite light and unstable so that when a gas nozzle which is equipped with a gasoline fume return hose is applied to the can, the force which must be applied to the gas can in order to compress the gasoline return hose to its compressed operative position is also likely to either tip the can over or force it away from underneath the nozzle. In either case, a displacement of the gasoline can results in spilled gasoline which more than offsets the gains in air pollution control for which the equipment associated with the gasoline nozzle is supposed to prevent. In addition to the environmental damage caused by the spilled gasoline, a fire hazard is created which often results in a call to the fire department as a precaution while the spill is being cleaned up. Many older cars, particularly antique cars such as the Model A Ford as well as certain foreign makes of cars are also not well suited to be serviced by gas nozzle which is equipped with a gasoline fume return hose. In some cases, the opening to the gasoline tank is not particularly well suited for such a gasoline nozzle. In some case, the gasoline tank is so constructed that the rigid tube portion of the nozzle extends down to the bottom of the tank so that the tank cannot be filled with gasoline or filled with only a fraction of its capacity. This problem is particularly acute with motorcycles. Also, the area around the opening to the gas tank of a motorcycle has a very fine finish which is likely to be damaged by the pressure of the gasoline fume return hose when it is forcibly applied against this finish. The only way to effectively fill the gasoline tank of a motorcycle is to hold the housing of the nozzle near the trigger mechanism with one hand while compressing the gasoline return hose with the other hand until the valve can be opened by the operation of the trigger mechanism while inserting the rigid tube only a short distance into the opening of the gasoline tank. This is very objectionable to the user and represents a source of irritation each time that such equipment is used. These and other difficulties experienced with the prior art gasoline nozzles have been obviated by the present invention.

It is therefore, a principle object of the invention to provide an improvement for a gasoline nozzle which is equipped with the gasoline fume return hose which enables the nozzle to be used with ease for filling gasoline receptacles which are difficult to fill with nozzles of this type.

Another object of this invention is the provision of an adapter for use with a gasoline nozzle which is equipped with a gasoline fume return hose which enables the nozzle to be used with ease to fill gasoline receptacles which are normally difficult to fill with nozzles of this type.

A further object of the present invention is the provision of a method of using a gasoline nozzle which is equipped with a gasoline fume return hose to enable the nozzle to be used with ease for filling gasoline receptacles which are difficult to fill with nozzles of this type.

With these and other objects in view, as will be apparent to those skilled in the art, the invention resides in the combination of parts set forth in the specification and covered by the claims appended hereto.

SUMMARY OF THE INVENTION

In general, the invention consists of an improved for a gasoline nozzle which is equipped with a gasoline fume return hose. The nozzle includes a housing which contains a normally closed valve and a trigger mechanism on the housing for opening the valve. A rigid cylindrical tube extends from the housing and terminates in an opened outer end. An outer annular protuberance is located on the outside of the rigid tube between the outer end of the tube and the housing. The inner end of a flexible gasoline fume return hose is connected to the housing and surrounds the rigid tube. The outer open end of the hose is aligned with the outer open end of the rigid tube. The hose is compressible from an expanded state in which the ends of the hose and the tube are aligned to a compressed state in which the outer open end of the hose is between the protuberance and the housing. The hose is biased to its normal extended position by an internal spring wherein the valve within the housing cannot be effectively opened by the trigger mechanism. When the hose is compressed relative to the rigid tube so that the outer end of the hose is beyond the protuberance, the nozzle is rendered operative wherein the valve can be opened by actuation of the trigger mechanism. The improvement comprises a slotted adapter which is interposed between the protuberance and the outer end of the hose when the outer end of the hose is located between the protuberance and the housing of the nozzle. The adapter is positioned so that the rigid tube is located in the slot of the adapter wherein it is clamped between the protuberance and the outer end of the hose, thereby maintaining the nozzle in the operative gas dispensing condition.

BRIEF DESCRIPTION OF THE DRAWINGS

The character of the invention, however, may be best understood by reference to some of its structural forms, as illustrated by the accompanying drawings, in which.

DETAILED DESCRIPTION OF THE INVENTION

Figure 1:
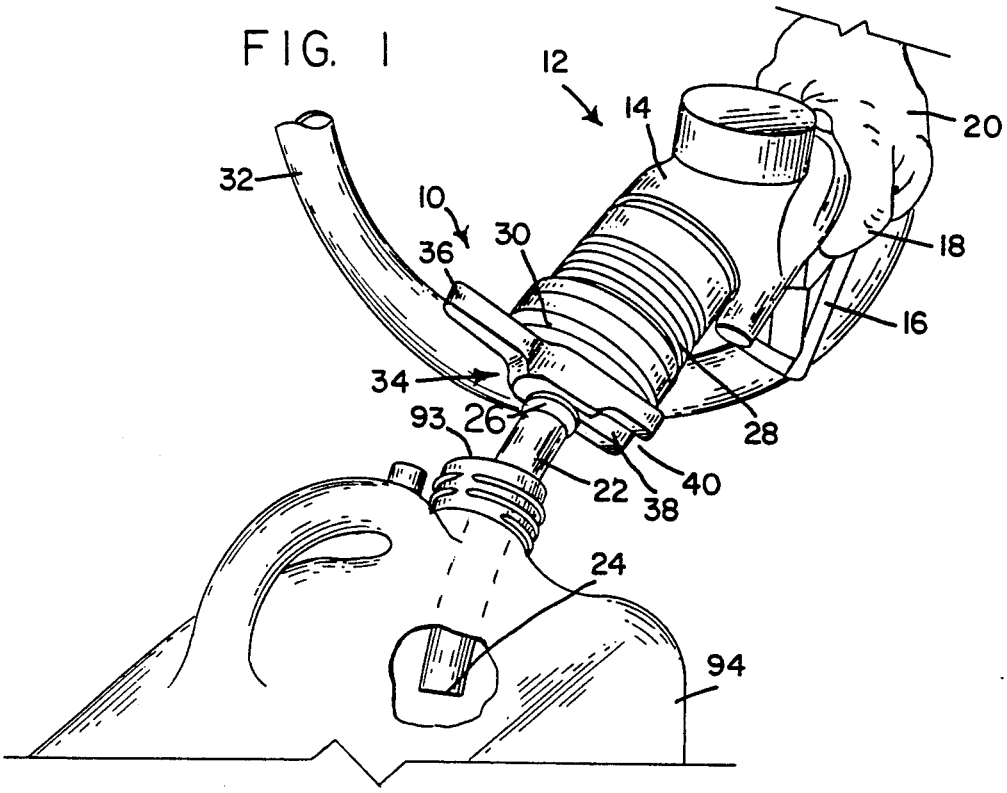
FIG. 1 is a perspective view of the improved gasoline nozzle of the present invention showing a first embodiment on the adapter which forms part of the present invention in an operative position.

Referring to FIGS. 1-6 there is shown a first embodiment of the adapter of the present invention which is generally indicated by the reference numeral 10 and is shown applied to a gasoline nozzle which is generally indicated by the reference numeral 12. The nozzle 12 is operatively connected to a gasoline pump (not shown) through a gas delivery hose 32. The nozzle 12 comprises a housing 14 which contains a normally closed valve and a trigger mechanism which is generally indicated by the reference numeral 16 and which includes an outwardly extending trigger which, in the example shown in FIG. 1, is depressed by the index finger 18 of a users hand 20. The nozzle 12 also includes a rigid generally cylindrical tube 22 which is connected to the housing 14 and which extends outwardly from the housing and terminates in a free open end 24. The rigid tube 22 lies within a flexible gasoline fume return hose 28 which has a bellows-like construction that enables the hose to be compressed from a fully-extended state in which it surrounds the rigid tube 22 to a compressed state as shown in FIG. 1. The inner end of the hose 28 is fixed to the housing. The hose 28 extends outwardly from the housing 14 and terminates in a free open end 30 which is aligned with the open end 24 of the rigid tube 22 when the hose is fully extended. The hose 28 contains a spring which normally biases the hose 28 in the expanded state in which it surrounds the tube 22. The housing 14 also contains a control mechanism which interacts with the hose 28 so that when the hose 28 is in the expanded state, the trigger mechanism 16 is ineffective for opening the valve within the housing so that gasoline will not flow through the tube 22. When the end 30 of the hose 28 is pushed toward the housing 14 against the bias of the spring within the hose to the compressed state as shown in FIG. 1, the control mechanism within the housing enables the trigger mechanism 16 to effectively open the valve within the housing when the extending trigger of the trigger mechanism is depressed by the index finger of the user. This enables gasoline to be delivered into a receptacle through the tube 22. The tube 22 contains an outer circular protuberance 26 which is located between the outer end 24 and the housing 14. When the hose 28 is in its compressed state (as shown in FIG. 1), the outer end 30 of the hose is beyond the protuberance 26 on the inward side of the protuberance. When the nozzle 12 is used for delivering gasoline to most modern vehicles, the adapter 10 which is shown in FIG. 1 is not utilized. At the beginning of a fill-up operation, the outer end 30 of the hose 28 is aligned with the outer end 24 of the tube 22. The end 24 of the tube 22 is positioned at the opening to the gas tank of the vehicle and the tube 22 is pushed through the opening. However, the end 30 of the hose 28 is substantially larger than the opening to the gasoline tank so that when the tube 22 is pushed through the opening to the gasoline tank, it is restrained by the material around the opening. When sufficient force is applied to the nozzle 12, the tube 22 descends deeper into the opening to the gasoline tank. The hose 28 is thereby compressed and the outer end 30 of the hose is moved beyond the protuberance 26. At this point, gasoline can be delivered into the gasoline tank of the vehicle by the nozzle 12 by actuating the trigger mechanism 16.

When the nozzle 12 is used for filling a difficult to fill receptacle such as the gasoline can 94, the nozzle 12 is used in conjunction with the adapter 10 in the manner shown in FIG. 1 by interposing the adapter between the protuberance 26 in the outer end 30 of the hose 28 as shown in FIG. 1 in a manner to be described hereinafter.

Figure 4:
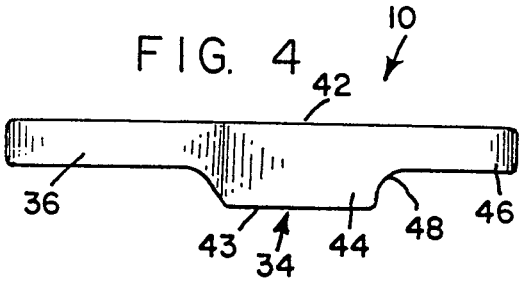
FIG. 4 is a side elevational view of the first embodiment looking in the direction of arrow IV in FIG. 2.
Figure 2:
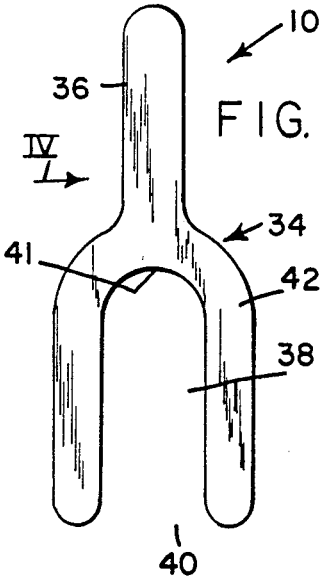
FIG. 2 is a top plan view of the first embodiment.
Figure 5:
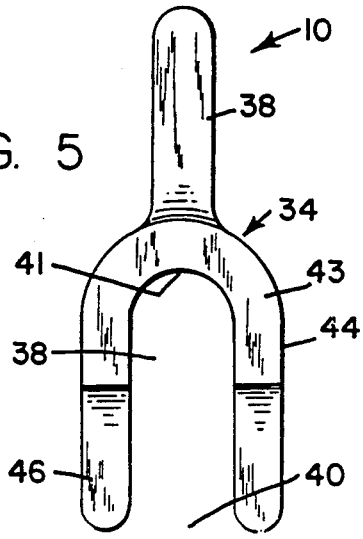
FIG. 5 is a bottom plan view of the first embodiment.
Figure 3:
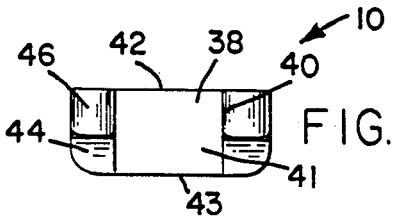
FIG. 3 is a front elevational view of the first embodiment.
Figure 6:
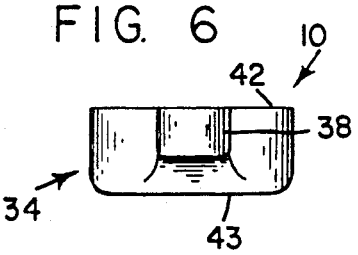
FIG. 6 is a front elevational view of the first embodiment adapter.

Referring particularly to FIGS. 2-6, the adapter 10 comprises a main body portion, generally indicated by the reference numeral 34 and handle 36. The main body portion has a slot 38 which extends from an outer opening 40 to an inner concave radial surface 41. The width of the slot 38 is slightly greater than the diameter of the rigid tube 22 and less than the diameter of the protuberance 26. The main body portion 34 has a flat upper surface 42 and a flat bottom surface 43. As shown in FIG. 4, the main body portion has a relatively thick section 44, a relatively thin section 46 near the opening 40 and a curved transition section 48 between the sections 44 and 46. The preferred minimum width of the slot 38 is between 13/16" and ⅞".

The adapter 10 is utilized with the gasoline nozzle 12 for filling gasoline receptacles which are difficult to fill with nozzles of this type. The nozzle 12 is grasped by the user and the outer end 30 of the hose 28 is pushed toward the housing 14 against the bias of the spring within the hose until the outer end of the hose is substantially beyond the protuberance 26. At this point the adapter 10 is inserted between the protuberance 26 and the outer end 30 of the hose so that the rigid tube 22 is located within the slot 38. The relatively thin section 46 makes it easier to insert the adapter between the protuberance and the hose 30 even if the end of the hose is not completely at its fully compressed position in which the trigger mechanism 16 is effective for opening the valve within the housing 14. The transition section 48 acts as a cam to enable the protuberance 26 to move easily from the relatively thin section 46 to the relatively thick section 44. In this position, the protuberance rests against the bottom surface 43 and forces the end 30 of the hose to its final operative compressed position as shown in FIG. 1. The minimum thickness of the section 44 between the surfaces 42 and 43 is approximately 11/16 of an inch. This thickness will ensure that the hose 28 is compressed sufficiently to enable the nozzle 12 to be functional. The bias of the hose 28 effectively clamps the adapter 10 between the end 30 of the hose and the protuberance 26 so that it will remain in place and the nozzle 12 can be operated with one had as shown in FIG. 1. The rigid tube 22 is inserted through the opening of a gasoline receptacle which is to be filled. In the example shown in FIG. 1, the tube 22 extends into the opening 93 of a gasoline can 94. The user then actuates the trigger mechanism by squeezing the trigger which protrudes from the housing 14 with the index finger 18 thereby opening the valve within the housing 14 and allowing gasoline to flow through the rigid tube 22 into the gasoline receptacle. After the receptacle has been filled, the trigger mechanism is released and the rigid tube is removed from the opening of the receptacle. The adapter 10 is then removed from the nozzle 12 by pulling on the handle 36 so that the main body portion 34 slides out from its straddling position with respect to the rigid tube 22. This allows the hose 28 to return to its normal extended position wherein the out opening 30 of the hose is aligned with the outer opening 24 of the rigid tube 22. Although the outer end of the hose is spaced from the tube 22, some of the fumes emanating from the tube are drawn into the hose.

Figure 7:
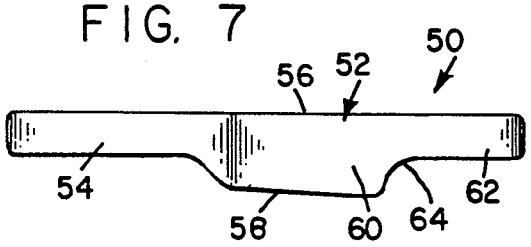
FIG. 7 is a side elevational view of a second embodiment of the adapter.

Referring to FIG. 7, there is shown a second embodiment of the adapter portion of the present invention which is generally indicated by the reference numeral 50 and comprises a main body portion which is generally indicated by the reference numeral 52 and a handle 54. The main body portion 52 comprises a relatively thin section 62, a relatively thick section 60 and a transition section 64 between the thin section 62 and the thick section 60. The main body portion 52 has a flat upper surface 56 and a flat lower surface 58. The adapter 50 is identical to the adapter 10 except that the upper and lower surfaces of the main body portion are not parallel. The lower surface 58 tapers toward the upper surface 56 in the direction of the handle 54. This relationship between the upper and lower surfaces has two benefits. First, the adapter forms a wedge-like structure between the protuberance 26 and the end 30 of the hose 28 to ensure that the adapter 50 maintains its holding position during a filling operation. The wedge-like shape of the relatively thick section 60 also insures that the rigid tube 22 is seated against the inner end of the slot so that there is some engagement between the lower surface 58 and the protuberance in the event that the protuberance 26 has a less than normal diameter. Also, the width of the slot can be made somewhat larger to accommodate all of the size variations of the tube 22 and protrusion 26.

Figure 8:
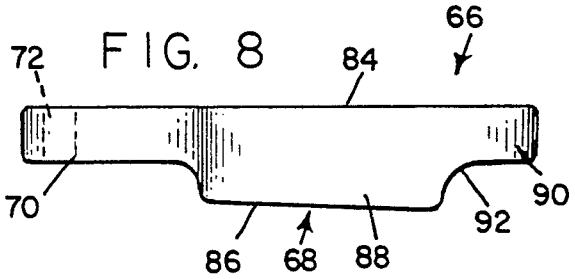
FIG. 8 is a side elevational view of a third embodiment of the adapter.
Figure 9:
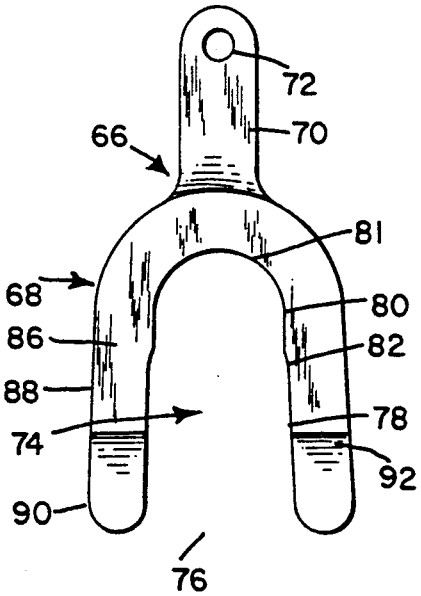
FIG. 9 is a bottom plan view of the third embodiment.

Referring to FIGS. 8 and 9, there is shown a third embodiment of the adapter which is generally indicated by the reference numeral 66 and comprises a main body portion which is generally indicated by the reference numeral 68 and a handle 70. The handle 70 has an aperture 72 to enable the adapter to be suspended from key chain or any other comparable carrying mechanism. The main body portion 68 has an upper flat surface 84 and a lower flat surface 86. The lower surface 86 tapers toward the surface 84 in the direction of the handle 70. The main body portion 68 has a slot which is generally indicated by the reference numeral 74 and which extends from an outer opening 76 to an inner concave radial surface 77. The slot 74 has a relatively wide portion 78 adjacent the opening 76 and a relatively narrow portion 80 adjacent the end surface 77. A curved transition section 82 connects the relatively wide portion 78 to the relatively narrow portion 80. The main body portion 78 consists of a relatively thin section 90 adjacent the opening 76 and a relatively thick section 88 adjacent the end surface 77 and a transition section 92 between the thin section 90 and the thick section 88. The adapter 66 is used in the same manner as the adapters 10 and 50 and provides added versatility with respect to variations in the size of the protuberance 26. The width of the relatively narrow portion 80 is approximately $\frac{7}{8}$ of an inch, ideally 0.86 inches. This dimension is slightly larger than the diameter of most tubes 22 which are currently in use. The greater width of the relatively wide portion 78 will accommodate gasoline nozzles which have an oversize or relatively larger than normal tube 22. In addition, the wide portion 78 tapers inwardly from a relatively large dimension at the opening 76 to a relatively small dimension at the transition section 82. This variation in width will accommodate for size variations in the tubes of the relatively large-type. The range in sizes of the relatively large type of tube will be accommodated at some point between the opening 76 and the transition portion 82. The width of the relatively wide portion 78 at the transition portion 82 is approximately 1 inch 0.97 inches being ideal. This dimension is also the radius of the curved transition portion 82 so that a large dimension tube 22 will seat into the transition portion 82. The relatively narrow portion 80 of the slot will accommodate a relatively small dimension tube 22 which will seat against the end surface 77. The wedge shape of the main body portion 68 also insures that the tube 22 will be seated against the end surface 77 for a smaller tube or against the transition portion 82 for a relatively large tube. The width of the wide portion 78 at the opening 76 is at least one inch and preferably less than an inch at the transition portion 82. As in the case of the adapter 50, the wedge shape of the main body portion 68 ensures that the adapter 66 will remain firmly in place when inserted between the protuberance 26 and the end 30 of the gasoline fume return hose when the nozzle is utilized for pumping gasoline into a receptacle.

Clearly, minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A method of utilizing a gasoline pump nozzle which is equipped with a gasoline fume collection means for filling with gasoline receptacles which are suitable for being filled with a traditional gasoline pump not equipped with said gasoline fume collection means and not suitable for being filled with a nozzle which is equipped with said gasoline fume collection means, a gas pump nozzle which is equipped with gasoline fume collection means having a trigger mechanism, a valve which is actuated by said trigger mechanism, a cylindrical rigid tube which has a outer open end, an inner end which is operatively connected to said valve and an outer annular protuberance between said inner and outer ends, said nozzle having a flexible gasoline fume return hose which has an outer open end and which surrounds said rigid tube so that the outer end of said hose is aligned with the outer end of said rigid tube along the central longitudinal axis of the rigid tube, said hose being resiliently compressible along said axis to enable the outer end of the hose to be moved inwardly away from the outer end of the rigid tube against the bias of the hose so that the inner end of the rigid tube extends substantially beyond the outer end of the hose, said nozzle having a control mechanism which prevents said valve from being opened by the actuation of said trigger mechanism when the outer ends of said rigid tube and said hose are aligned, said control mechanism enabling said valve to be opened by said trigger when said hose is compressed so that the outer end of said hose is substantially spaced from the outer end of said rigid tube, including a position along said rigid tube which is between said protuberance and the inner end of said rigid tube, said method comprising:

(a) grasping the nozzle and moving the outer end of the hose inwardly along said axis away from the outer end of the rigid tube so that the outer end of the hoses substantially beyond said protuberance, (b) inserting a slotted adapter which straddles the rigid tube between the outer end of the hose and the protuberance and engages the protuberance, (c) releasing the end of the hose so that the adapter is clamped between the hose and the protuberance by the bias of the hose, (d) inserting the rigid tube into the receptacle to be filled, (e) squeezing the trigger mechanism to enable gasoline to be pumped into the receptacle until the receptacle is filled with a desired amount of gasoline, (f) releasing the trigger mechanism, (g) removing the rigid tube from the receptacle, and (h) removing the adapter from the nozzle.

2. The method of utilizing a gasoline pump nozzle as recited in claim 1, wherein the adapter which is utilized in step (b) has an opening to the slot and the slot has a width which is greater than the diameter of the rigid tube and less than the diameter of the protuberance.

3. A gasoline nozzle for connection to a gasoline pump through a gasoline delivery hose, said nozzle comprising:

(a) a housing which contains a normally closed valve, (b) a trigger mechanism on said housing for opening said valve, (c) a rigid cylindrical tube having an inner end which is operatively connected to said valve and an outer open end, (d) an outer annular protuberance on said tube between said inner and outer ends, (e) a flexible gasoline fume return hose which surrounds said rigid tube, said fume return hose having an inner end which is fixed to said housing and an outer open end which is normally biased into alignment with the outer open end of said rigid tube, said fume return hose being compressible from its outer end for movement along the length of said rigid tube from the outer end of the rigid tube to a position between the housing and said protuberance, (f) a control mechanism which is operatively connected to said flume return hose and said valve to prevent said valve from being opened by said trigger mechanism when said fume return hose is at its normal extended position and to enable said valve to be opened by said trigger mechanism when said fume return hose is compressed so that the outer end of the fume return hose is at said position between the housing and said protuberance, and (g) an adapter comprising a main body portion which has a slot and an opening to the slot and a handle which is fixed to said main body portion, said slot having a width which is greater than the outer diameter of said rigid tube and less than the outer diameter of said protuberance, to enable said main body portion to be interposed between said protuberance and the outer end of said fume return hose so that the rigid tube is within said slot when said fume return hose is compressed to the extent that the outer end of said fume return hose is at said position beyond the housing and said protuberance, whereby said adapter is biased against said protuberance by the outer end of said fume return hose and said valve can be opened by the actuation of said trigger mechanism.

4. A gasoline nozzle as recited in claim 3, wherein said main body portion has a relatively thick section at the end of the slot which is furthest from said opening, a relatively thin section adjacent said opening and a transition section between said thin and thick sections which has a gradual increase in thickness form said thin section to said thick section.

5. A gasoline nozzle as recited in claim 3, wherein the inner end of said slot is defined by a concave radial surface which has a radius which is substantially equal to the radius of said rigid tube.

6. A gasoline nozzle as recited in claim 5, wherein said main body portion comprises:

(a) a flat upper surface for engaging the end of said hose, and (b) a flat lower surface which tapers gradually toward said upper surface in the direction of said handle.

7. A gasoline nozzle as recited in claim 3, wherein said main body portion comprises:

(a) a flat upper surface for engaging the end of said hose, and (b) a flat lower surface which tapers gradually toward said upper surface from a point adjacent said handle towards the opening of said slot.

8. A gasoline nozzle as recited in claim 3, wherein said slot has an outer relatively wide portion adjacent said opening and an inner relatively narrow portion inwardly of said outer portion.

9. A gasoline nozzle as recited in claim 8, wherein said outer portion has a maximum width at said opening and tapers inwardly toward said inner portion to a minimum width at said inner portion.

10. A gasoline nozzle as recited in claim 3, wherein said slot has a maximum width at said opening and tapers inwardly away from said opening to a minimum width at a point which is spaced substantially inwardly of said opening.

11. A gasoline nozzle as recited in claim 10, wherein said main body portion comprises:

(a) a flat upper surface for engaging the end of said hose, and (b) a flat lower surface which tapers gradually toward said upper surface in the direction of said handle.

* * * * *